United States Patent [19]

Witmer

[11] Patent Number: 4,696,226

[45] Date of Patent: Sep. 29, 1987

[54] FLUID BARRIER CURTAIN SYSTEM

[76] Inventor: Warner H. Witmer, Penn Center Plaza, Quakertown, Pa. 18951

[21] Appl. No.: 901,380

[22] Filed: Aug. 28, 1986

[51] Int. Cl.[4] ..... F24F 9/00

[52] U.S. Cl. ..... 98/36; 432/64

[58] Field of Search ..... 432/242, 64, 115; 98/36

[56] References Cited

U.S. PATENT DOCUMENTS

| | | | |
|---|---|---|---|
| 2,939,374 | 6/1960 | Caille | 98/36 |
| 3,068,775 | 12/1962 | Zehnder | 98/36 |
| 3,163,024 | 12/1964 | Beckwith et al. | 98/36 |
| 3,397,631 | 8/1968 | Simons | 432/64 |
| 3,543,532 | 12/1970 | Gratton et al. | 98/36 |
| 3,625,133 | 12/1971 | Hayashi | 98/36 |
| 3,812,684 | 5/1974 | Brown | 98/36 |
| 3,834,293 | 9/1974 | Danieli | 432/64 |
| 3,935,803 | 2/1976 | Bush | 98/36 |

*Primary Examiner*—Henry C. Yuen

*Attorney, Agent, or Firm*—John W. Logan, Jr.

[57] ABSTRACT

A fluid barrier curtain at an aperture in a wall within a duct, as at the entrance to a furnace, is disclosed that maintains separation of fluids on opposite sides of said barrier curtain while permitting passage of objects therethrough. The barrier curtain comprises aperture zone defining means, means for shaping a fluid flow into a laminar sheet pattern and forcing said fluid across said aperture zone, receiving means having thin-edged vanes located opposite said fluid flow shaping means for receiving the resulting flow, so as to remain laminar, and a fluid supply to said fluid flow shaping means.

5 Claims, 5 Drawing Figures

FLUID BARRIER CURTAIN SYSTEM

BACKGROUND OF THE INVENTION

A fluid barrier curtain maintains the separation of fluids on opposite sides of the curtain while allowing objects to pass therethrough. Such a curtain is especially useful in industries where the controlled preservation of a fluid treament zone is necessary. One example of use of fluid barrier curtains is with heat treating furnaces. Typically, a mechanical conveyor is employed to carry a continuous series of articles to be heat treated into the furnace through an access aperture, through the tunnel space in the furnace, and out of the furnace through another access aperture. A requirement of some industrial heat treating furnaces and ovens of the continuous type is maintenance of carefully controlled and dried atmosphere within the heat treatment chamber in the furnace. Optimum control of furnace atmosphere requires maximum exclusion of infiltrating outside air, minimizing inter-diffusion of side-by-side separate atmospheres and minimizing intermixing between the furnace atmosphere and the curtain gas.

Prior to the present invention, it has been the practice to provide physical baffles, such as hinged metal doors, or flame curtains located at the entrance and exit of the heat treating chamber for resisting the influx of atmospheric air. These devices tend to be only marginally satisfactory in eliminating intermixing of gases in heat treating apparatus. Baffles arranged for movement when workpieces are introduced in a continuous furnace system allow intermixing of outside air into the internal atmosphere with consequent non-uniform heat treating results. Hydrogen furnaces, since they are particularly sensitive to mixing of trace air, are sometimes constructed in a so-called "hump back" design in order for the lighter hydrogen to drift to the top of the furnace thus aiding in excluding outside air but at the expense of flame burning curtains continuously burning off hydrogen at the air-hydrogen interface. Flame curtains require large amounts of expensive hydrogen, create water vapor as a by-product, allow carbon deposits to appear on the workpiece, and otherwise provide additional heat for the workpiece that may be objectionable.

Heat treating results using state of the art gas curtains allow intermixing of curtain gas and interior furnace gas resulting in variable reducing conditions.

One form of gas curtain for industrial furnaces is described by Francis, et al. in U.S. Pat. No. 4,448,610 issued May 15, 1985. Inert gas emerges from holes in a tube located at the ceiling of a furnace opening, the holes being angled inward in an attempt to force back furnace atmosphere. A similar system is described by Colby in U.S. Pat. No. 1,725,059 except that a small tube with holes directs curtain gas straight downward across a furnace opening. Between the times of these patents, other patents show varying gas curtain schemes of similar overall approach. For example, forced blown gas angled inward toward furnace atmosphere, intended to be recirculated and reexhausted, is disclosed by Nowack in U.S. Pat. No. 4,298,341 issued Nov. 3, 1981. A perforated pipe gas curtain arrangement for furnace atmosphere control is described in U.S. Pat. No. 3,931,684 by Trumball, et al. In this disclosure humid air issues from holes in a pipe toward a narrowed inlet heating chamber where baffles together with an exhaust pipe are intended to reduce escape of volatile gases from the curing chamber.

Foeling et al. described in U.S. Pat. No. 3,672,948 a transverse flow of gas across wafers transported longitudinally along a furnace with little concern for intermixing of ambient air except by narrowing of the input port. Tamm's U.S. Pat. No. 3,363,533 shows a blower operated nozzle blowing forced air at an angle between 15 degrees and 25 degrees so as to split the airflow into two unequal horizontal currents—a major current directed toward the warm interior atmosphere of the furnace, and the second current directed toward the colder atmosphere at the end of the furnace whereby this current stream rebounds from the furnace floor.

An apparatus showing a spray discharge downward against the floor of a furnace opening combined with an exhaust chimney arrangement is disclosed by Thompson in U.S. Pat. No. 3,223,396.

Gas curtain apparatus for protecting an area for surgical operation is disclosed in U.S. Pat. No. 4,140,015 by Duvlis wherein sterile air is ejected from a blower, directed across a surgical operating area, and then aspirated by a respective intake of a suction unit. A sterile curtain of air directed across an opening during the time a door is opened in an enclosure is described by Copp in U.S. Pat. No. 3,221,632.

Air curtains for doorways are described by Jansson in U.S. Pat. No. 4,074,620 wherein air jets forth from slots in a doorway so as to attempt prevention of cold air flowing into a room. Another doorway air curtain is described by London in U.S. Pat. No. 3,086,441 wherein air is forced downward as by a blower discharging it from nozzles across a doorway. Zehnder describes in U.S. Pat. No. 3,068,775 varied vane airscreens directing forced air toward cold air to keep it from entering a room.

SUMMARY OF THE INVENTION

A new fluid barrier curtain arrangement at the aperture of a furnace or other structure or apparatus is disclosed that provides an efficient barrier to the inter-mixing of a first fluid on one side of the barrier with fluid on the opposite side of it. In accordance with the current invention, a fluid barrier curtain at an aperture is disclosed which comprises an aperture zone defining means through which objects may pass, means for supplying fluid to said zone, means for shaping said supplied fluid flow into a laminar sheet and forcing it into said zone, and means located opposite said shaping means for receiving a resulting flow stream and fluids entrained therewith. Such fluid barrier curtains may be used in multi-curtain arrays, to minimize or avoid simultaneous disruption of all curtains at one portal region.

OBJECTS OF THE INVENTION

It is an object of the present invention to provide a fluid curtain separation barrier to minimize or substantially prevent intermixing of fluids separated thereby.

A second object of the invention is to provide a fluid curtain barrier for retaining substantial separation of the atmospheres on opposite sides of the curtain.

Another object of the present invention is to provide fluid curtains for substantially preventing intermixing of outside ambient atmosphere with the internal atmosphere of a heat treating furnace.

It is another object of the present invention to provide fluid curtains using an inert gas to isolate the internal atmosphere of a furnace.

It is still another object of the present invention to provide fluid curtains wherein an inert gas is directed across a duct of a heat-treating furnace and collected at an opposite portion of the duct in a collecting chamber.

A further object of the invention is to provide substantial separation of gaseous atmospheres by means of at least two fluid curtains so as to allow workpiece transfer from one atmosphere to the other without causing intermixing of the contiguous atmospheres.

These and other objects and advantages of the present invention will be readily apparent to those skilled in the art by reading the following Detailed Description of the Invention and the appended claims.

DETAILED DESCRIPTION OF THE INVENTION

The structure selected for illustration is not intended to serve as a limitation upon the scope or teachings of the invention, but is merely illustrative thereof, and there may be considerable variations and adaptations of all or part of the teachings thereof depending upon the dictates of commercial practice.

Figure 1:
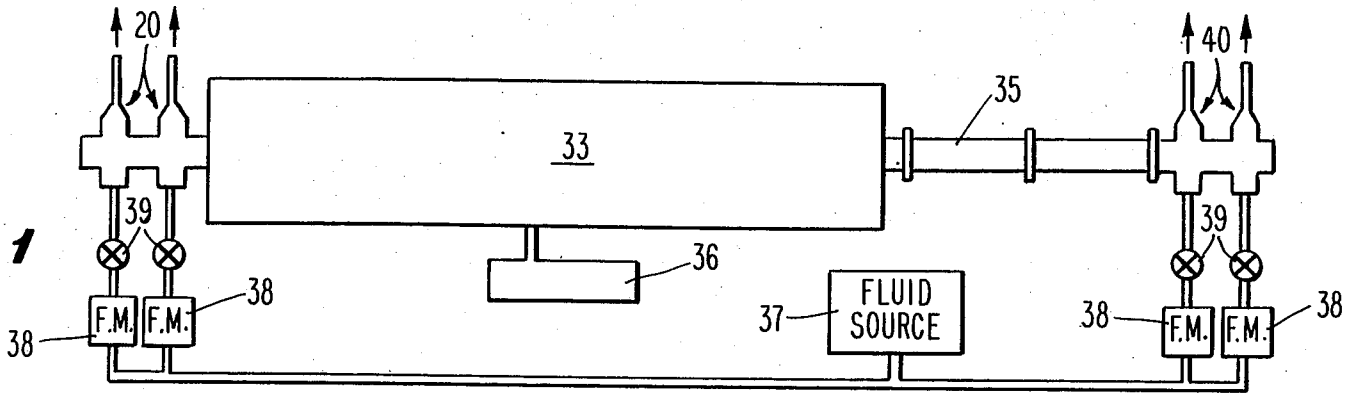
FIG. 1 is a schematic elevational view of the fluid curtains joined to a conventional heat treatment furnace.
Figure 2:
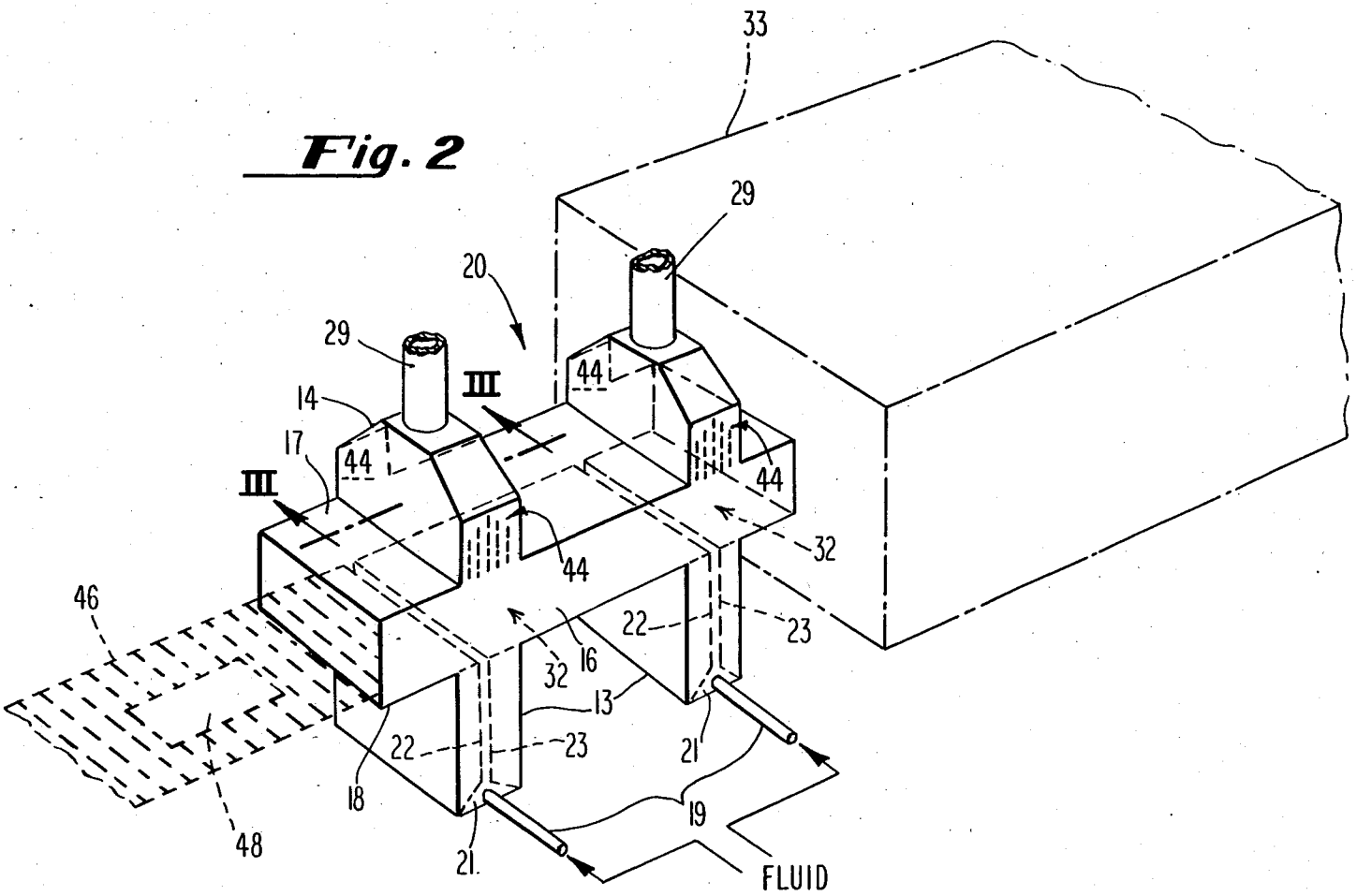
FIG. 2 is a perspective view of the front end of the furnace showing the attachment of the fluid curtain units.

FIG. 1 shows schematically a side elevation of a curtain barrier system of a pair of fluid curtains 20 at the input end of a furnace 33 or other heat-treatment apparatus and a second pair of curtains 40 at the output end of the cooling portion 35 of furnace 33. FIG. 2 shows a perspective view of curtains 20 and shows a conveyor 46 feeding an object 48 (both in phantom) to be cured, through a duct 31, and then two successive aperture zones, 32, 33 as it travels through curtains 20 and into the furnace 33 (shown in phantom). The desired atmosphere inside furnace 33 (e.g. hydrogen) is maintained by the gradual infusion of the desired gas from a source 36 (e.g. a bottled-gas source). A fluid, such as an inert gas, like nitrogen, is supplied from source 37 and is introduced under pressure through flow meters 38 and valves 39 into fluid curtain units 20 and fluid curtain units 40 according to the manner to be described below.

Curtains 20 and 40 are similar to each other in size and construction, and therefore the following description of one will pertain to all of them. If two curtains are used at each end of the system, as shown in FIGS. 1 and 2, the spacing between the curtains of each pair is preferably such that the full length of object 48 will clear the first such curtain before entering the second such curtain. In the same way, three curtains could be used at each end of a furnace (not shown) to accommodate different sized objects in the same production run, in order to maintain the desired atmosphere in the furnace. An inlet pipe 19 leads into the intake chamber 21 of the fluid emitting part 13 of each curtain unit (e.g. a curtain unit of units 20 or 40). The inlet pipe 19 provides communication from source 37 (not shown in FIG. 2 or FIG. 3), which may be a bottled gas unit containing nitrogen. The construction of each curtain unit is such that the duct 31 has oppositely-located side walls 16 (only one side shown in FIG. 2) that are joined to the ceiling 17 and the floor 18, as is known in the art. As will be more fully described later, a stack 29 extends from a box-like collector housing 14, which housing 14 is joined to ceiling 17 at a predetermined location immediately above the fluid curtain emitter unit 13.

Figure 3:
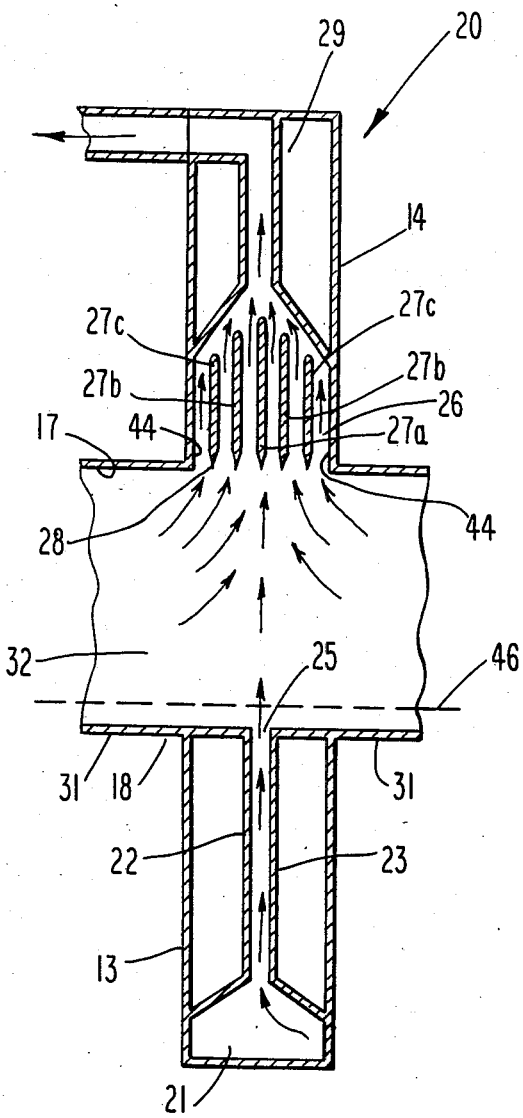
FIG. 3 is a cross-sectional view taken along lines III—III of FIG. 2.
Figure 3A:
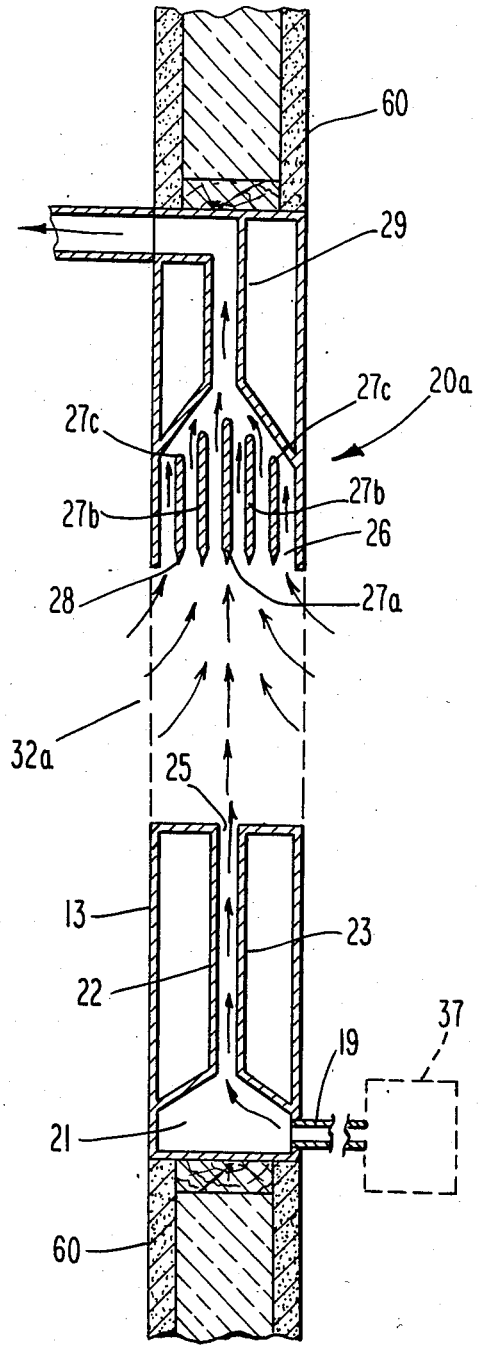
FIG. 3A is a cross-sectional view of a fluid curtain system of the present invention installed in an opening in a wall or partition.

FIG. 3 shows a side elevation view, primarily in cross-section, of one of the curtain units of curtain pair 20. FIG. 3A is a different embodiment of the invention wherein a single curtain system is built into an aperture 32*a* in wall 60. A fluid, such as the inert gas nitrogen, is supplied from source 37 (shown in FIG. 3A but not in FIG. 3). It is supplied via pipe 19 to the inlet chamber 21 as aforedescribed. In the emitter unit 13, plates 22 and 23 extend upward from the top of chamber 21, throughout the height of emitter 13 up to the horizontal planar surface at the bottom of duct 31. These plates 22 and 23 are spaced apart by a relatively small distance to concentrate the flow of the fluid into a predetermined laminar flow (as shown by the arrows between plates 22 and 23). The gap dimension between plates 22 and 23, and likewise the width of opening at 25, may be 3/16 inch. The distance preferably should not greatly exceed $\frac{1}{4}$ inch, in the absence of very large transverse dimensions of the duct. The fluid passes upward through the opening at 25. (Plates 22 and 23 are indicated in dashed lines in FIG. 2). The fluid (e.g. an inert gas, such as nitrogen) is in a laminar flow stream that emerges through opening 25, at a predetermined pressure. It proceeds through conveyor 46 (of a type for minimum obstruction to vertically-directed flows) toward the opposite wall (upper interior wall) of duct 31, and into a second chamber 26. Boxlike housing 14 which extends upward from duct 31 has a plurality of spaced-apart parallel collector vanes 27*a, b, c* attached at their opposite sides to opposite inner walls 44 thereof (not shown in FIGS. 3 or 3A), and fixed in a perpendicular alignment adjacent to the surface of ceiling 17 and transverse to the direction of movement of object 48. Each of collector vanes 27*a*, 27*b*, 27*c* has a very thin edge 28 confronting the interior of duct 31. Vanes 27*a*, 27*b*, 27*c* in chamber 26 are arranged to have the fluid stream arriving from opening 25 travel parallel to the centermost vanes 27*a*, 27*b* as shown by the arrows in FIGS. 3 and 3A. The distance from opening 25 to thin edges 28 can be as great as thirty times the gap dimension (gap width) of the width of opening 25 and still maintain the laminar flow with an appropriate gas flow velocity. Through entrainment, when a gas is used as the fluid, a small amount of atmosphere inside both furnace 33 and duct 31 will be directed parallel with outermost vanes 27*c* adjacent the outermost walls of housing 14, as represented by the arrows in FIGS. 3 and 3A. Further flow of all gas and atmosphere will proceed past the vanes adn through stack 29 and be collected for disposal. The components described above may be made of stainless steel or other suitable material.

Figure 4:
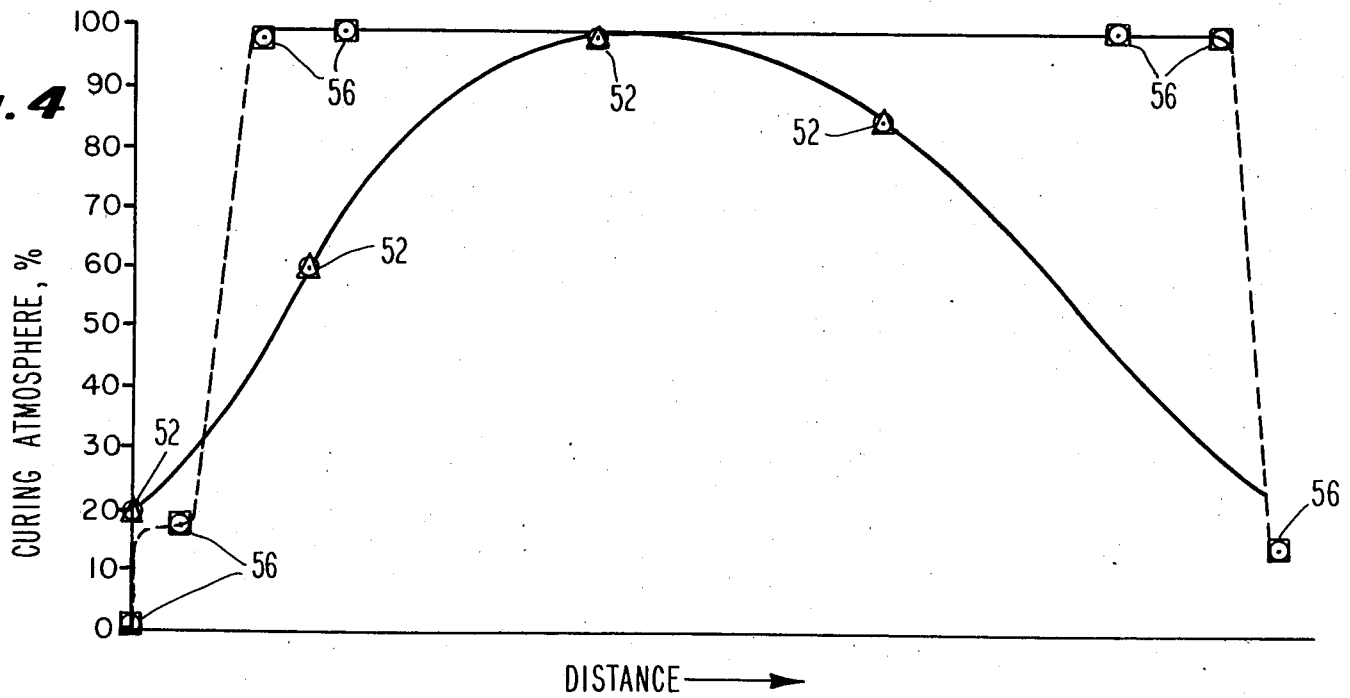
FIG. 4 is a graphic depiction of a gas profile of the present invention installed on a furnace as compared to a gas profile of a furnace with prior gas curtain arrangements.

FIG. 4 graphically depicts the comparison of a gas profile of a conventional curtain with that of the instant invention, with hydrogen being used as the internal atmosphere of furnace 33 and nitrogen gas (maintained under pressure) being used as the fluid from source 37 effective in curtains 20 and 40. As can be seen from the graph, with an inefficient curtain arrangement, the hydrogen profile may be somewhat like a bell-shaped curve, extending through the small triangles 52. This curve represents the strongest concentration of hydrogen near the middle of the furnace, and a weaker concentration near each end. In contrast to that gas profile curve is the hydrogen profile of the furnace equipped with the present invention. This graph, with the small square symbols 56, indicates the concentration of the curing gas hydrogen to remain quite high, near 100%, substantially from the inner curtain of the front pair 20 to the inner curtain of the rear pair 40. A side elevation view of the equipped furnace system is shown in FIG. 1 to enable the graph of FIG. 4 through symbols 56 to be better understood.

These and other variations in the details of the system may be made in accordance with the invention, which is to be broadly construed and to be defined by the scope of the claims appended hereto.

What I claim is:

1. A fluid barrier curtain at an aperture to maintain separation of fluids on opposite sides of said barrier curtain while permitting passage of objects through said aperture, comprising:

means defining an aperture zone through which objects may pass;

and a fluid curtain barrier system for substantially opposing transverse interchange of fluids across said aperture zone, said fluid curtain barrier system comprising means for supplying fluid to the fluid curtain barrier system, fluid flow shaping means directing the supplied fluid flow in a concentrated laminar sheet substantially within said zone and from one boundary of said zone toward an opposite boundary thereof, receiving means located opposite said laminar fluid flow shaping means for receiving a resulting flow stream and fluids entrained therewith and inducing the fluids arriving in its vicinity to be collected together and caused to emerge from said aperture zone as a coherent fluid effluent, said receiving means including an opening extending across the opposite boundary of said aperture zone, said opening being wider in the direction transverse of said aperture zone than the width of the laminar sheet of fluid exiting said fluid flow shaping means, a box-like housing extending from said opening away from the aperture zone, and a plurality of spaced-apart vanes fixedly poisitioned in said housing and having thin edges substantially coplanar with said opening, said vanes being substantially parallel to said aperture zone through which objects may pass and serving to separate the fluid flowing out of the aperture zone into laminar-flow segments.

2. A barrier curtain as defined in claim 1, wherein said fluid flow shaping means comprises:

an elongated narrow opening in a first wall at the aperture zone, and means for leading the fluid to said opening through a constricted thin flow space wherein the fluid is made to flow in a substantially laminar flow as it approaches said aperture zone.

3. A barrier curtain as defined in claim 2, wherein the gap dimension of said elongated narrow opening is at least one-thirtieth of the distance from said first wall to the opposite wall.

4. A barrier curtain as defined in claim 3, wherein said means for receiving fluid upon its traversal further comprises means for receiving said fluid between the vanes in the middle region of said box-like housing, and for receiving in the regions nearer the outermost walls of the box-like housing and farther from the plurality of vanes of the middle region some induced flow of other fluids.

5. A barrier curtain as defined in claim 4, said barrier curtain being installed in a wall and defining a passage therethrough.

* * * * *